US009064449B2

(12) United States Patent
Kerofsky et al.

(10) Patent No.: US 9,064,449 B2
(45) Date of Patent: Jun. 23, 2015

(54) ELECTRONIC DEVICES CONFIGURED FOR ADAPTING REFRESH BEHAVIOR

(75) Inventors: Louis Joseph Kerofsky, Camas, WA (US); Sachin G. Deshpande, Camas, WA (US)

(73) Assignee: Sharp Laboratories of America, Inc., Camas, WA (US)

( * ) Notice: Subject to any disclaimer, the term of this patent is extended or adjusted under 35 U.S.C. 154(b) by 740 days.

(21) Appl. No.: 13/355,282

(22) Filed: Jan. 20, 2012

(65) Prior Publication Data

US 2013/0187937 A1 Jul. 25, 2013

(51) Int. Cl.
*G09G 5/00* (2006.01)
*G09G 3/20* (2006.01)

(52) U.S. Cl.
CPC ..... *G09G 3/20* (2013.01); *G09G 2320/103* (2013.01); *G09G 2330/021* (2013.01); *G09G 2340/0435* (2013.01)

(58) Field of Classification Search
CPC ..... G09G 3/34–3/3496; G09G 2320/10–2320/106; G09G 2340/0435
USPC ..... 345/87–104, 204–213, 690–699
See application file for complete search history.

(56) References Cited

U.S. PATENT DOCUMENTS

| | | | | |
|---|---|---|---|---|
| 7,692,642 | B2 | 4/2010 | Wyatt | |
| 7,755,590 | B2 | 7/2010 | Park | |
| 7,898,535 | B2 | 3/2011 | Juenger | |
| 2006/0146056 | A1 | 7/2006 | Wyatt | |
| 2006/0170822 | A1* | 8/2006 | Baba et al. | 348/500 |
| 2007/0152993 | A1 | 7/2007 | Mesmer et al. | |
| 2007/0285428 | A1 | 12/2007 | Foster et al. | |
| 2009/0251445 | A1* | 10/2009 | Ito et al. | 345/204 |

FOREIGN PATENT DOCUMENTS

| | | |
|---|---|---|
| JP | 2000-181416 | 6/2000 |
| JP | 2004-288087 | 10/2004 |
| JP | 2008-527418 | 7/2008 |
| JP | 2009-518693 | 5/2009 |

OTHER PUBLICATIONS

International Search Report issued for International Patent Application No. PCT/2013/000237 on Mar. 19, 2013.

* cited by examiner

*Primary Examiner* — Stephen Sherman
(74) *Attorney, Agent, or Firm* — Austin Rapp & Hardman

(57) ABSTRACT

A method for adapting refresh behavior on an electronic device is described. The method includes operating according to an adaptive state that adapts a refresh rate for a display based on at least one frame. The method additionally includes transitioning from the adaptive state to a self refresh state based on a first self refresh state indication. The method further includes transitioning from the self refresh state to the adaptive state based on a second self refresh state indication.

26 Claims, 12 Drawing Sheets

ELECTRONIC DEVICES CONFIGURED FOR ADAPTING REFRESH BEHAVIOR

TECHNICAL FIELD

The present disclosure relates generally to electronic devices. More specifically, the present disclosure relates to electronic devices for adapting refresh behavior.

BACKGROUND

Electronic devices have become smaller and more powerful in order to meet consumer needs and to improve portability and convenience. Consumers have become dependent upon electronic devices and have come to expect increased functionality. Some examples of electronic devices include desktop computers, laptop computers, cellular phones, smart phones, media players, integrated circuits, etc.

Many electronic devices include a display for presenting information to consumers. For example, portable electronic devices include displays for allowing digital media to be consumed at almost any location where a consumer may be. For instance a consumer may use an electronic device with a display to check email, view pictures, watch videos, see social network updates, etc. In many cases, larger displays enhance usability and enjoyment for consumers.

However, the power requirements of a display may be problematic. For portable electronic devices, the power requirement of a display may significantly limit the battery life. The increasing demand for reducing power consumption while providing the same viewing experience for the consumer may be problematic. As can be observed from this discussion, systems and methods for reducing the power consumption of a display may be beneficial.

BRIEF DESCRIPTION OF THE DRAWINGS

FIG. 2 is a state diagram illustrating an adaptive state and a SELF state that the electronic device may operate according to;

DETAILED DESCRIPTION

Figure 1:
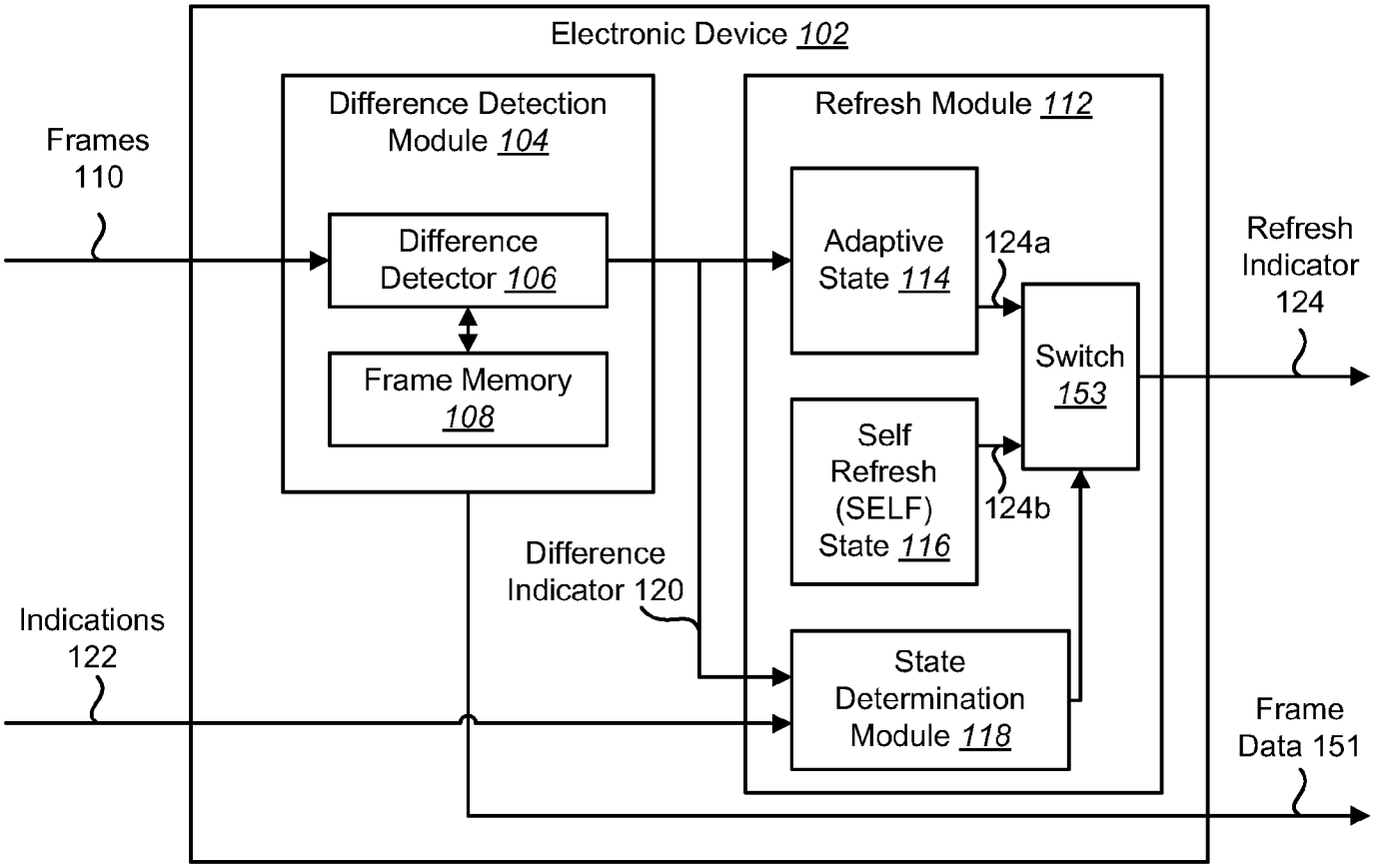
FIG. 1 is a block diagram illustrating an example of an electronic device in which systems and methods for adapting refresh behavior may be implemented.

A method for adapting refresh behavior on an electronic device is described. The method includes operating according to an adaptive state that adapts a refresh rate for a display based on at least one frame. The method also includes transitioning from the adaptive state to a self refresh state based on a first self refresh state indication. The method further includes transitioning from the self refresh state to the adaptive state based on a second self refresh state indication.

The self refresh state may indicate a refresh based on a static frame in memory. The refresh may be at a reduced refresh rate sufficient to maintain a static image on the display.

The method may include detecting a difference between at least two frames. The at least two frames may be compressed frames. Detecting a difference between the at least two frames may be based on a Sum of Absolute Difference (SAD) between the at least two frames. The at least two frames may be compressed frames.

The adaptive state may be a change adaptive state that indicates a refresh when a change is detected. The adaptive state may be a motion adaptive state that indicates a refresh for a fraction of the at least one frame.

The method may additionally include transitioning from the change adaptive state to a motion adaptive state when a number of large Sum of Absolute Difference (SAD) frames exceeds a first threshold. The motion adaptive state may indicate a refresh for a fraction of the one or more frames. The method may also include transitioning from one of the self refresh state, change adaptive state and motion adaptive state to a full refresh state when a full refresh state indication is obtained. The full refresh state may indicate a refresh for each of the one or more frames. The method may additionally include transitioning from the full refresh state to the change adaptive state when a number of small SAD frames exceeds a second threshold. The method may also include transitioning from the motion adaptive state to the self refresh state when the first self refresh state indication is obtained. The method may additionally include transitioning from the motion adaptive state to the change adaptive state when a number of zero SAD frames exceeds a third threshold. The method may further include transitioning from the self refresh state to the full refresh state when the full refresh indication is obtained. The full refresh indication may be based on touch information. The method may additionally include determining whether a state transition will occur following each frame.

The electronic device may reside in a host device. The electronic device may reside in a display device. The electronic device may be part of a Timing Controller (TCON) module.

An electronic device configured for adapting refresh behavior is also described. The electronic devices includes a processor and instructions stored in memory that is in electronic communication with the processor. The electronic device operates according to an adaptive state that adapts a refresh rate for a display based on at least one frame. The electronic device also transitions from the adaptive state to a self refresh state based on a first self refresh state indication.

The electronic device further transitions from the self refresh state to the adaptive state based on a second self refresh state indication.

The systems and methods disclosed herein may be used for reducing power consumption of a host and/or a display. In some configurations, the systems and methods disclosed herein may reduce power by enabling different states of operation for efficiently refreshing a display. For example, the different states of operation may be used to efficiently refresh different types of content (that are being displayed, for example). For instance, a first state of operation may be used for efficiently refreshing a display for fast changing content and a second state of operation may be used for efficiently refreshing a display for slow changing content. In some configurations, the systems and methods disclosed herein may transition between different states of operation. In some cases, the systems and methods disclosed herein may transition between a first state of operation and a second state of operation based on each frame. Some states may be signaled (e.g., signaled externally) while others are adapted automatically (within a display module, for example).

One known approach for reducing power consumption uses a self-refreshing display. For example, the self-refreshing display has recently been standardized in the embedded Display Port (eDP) 1.3 specification. A self-refreshing display may contain memory (e.g., video frame memory) and a control connection to a host device. The host device may command the display device to capture a frame to the memory and to continually refresh the display output from this memory while the host Graphics Processing Unit (GPU) enters a low power state (during which it does not transmit data over a main link). Thus, a self-refreshing display may allow the host device to signal to the display device to hold an image on the display. During this time, the host device may enter a low power state while the display device continues to refresh the image on the display from memory. In this design, the host device may be able to save power when static content is displayed. However, the power consumption of the self-refreshing display may not be reduced. In many cases, the self-refreshing display will refresh at a high rate, but from local memory rather than from data provided by the host device. Thus, in this known approach, the self-refreshing display may rely on control from a host.

Another known approach for reducing power consumption uses the display itself to hold the image value sent to a pixel. In this case, the display device may not need to refresh areas of the display which have not changed. For example, a low power mode for driving a liquid crystal display may detect changes in the data being displayed and may only update those regions of the display where the image content has changed. However, the power consumption of the host may not be reduced in this case, since the host device may not know it is acceptable to enter a low power state. It should be noted that this known approach is internal to the display only and does not communicate with the external host.

As discussed above, the systems and methods disclosed herein may enable different states of operation for efficiently refreshing a display (to reduce power consumption, for example). In some configurations, the systems and methods disclosed herein may use four display states (e.g., states of operation) and transitions between them to achieve one or more of power reduction and panel self-refresh functionality. A discussion of each display state is included below. Although four display states (e.g., the Full Refresh State, the Self Refresh State, the Motion Adaptive State and the Change Adaptive State) are discussed below, it is noted that the systems and methods disclosed herein may use two or more display states. In some configurations, the display states used may be additional and/or alternative to the four display states discussed herein.

The Full Refresh State may enable a display to operate at a maximum refresh rate. The maximum refresh rate may provide the highest motion quality at the highest power consumption. The Full Refresh State may be useful when interactive content is known to be displayed, such as when touch events are detected from a touch panel. In some configurations, entry into the Full Refresh State may be initiated by command (e.g., external command). In some configurations, exit from the Full Refresh State may be initiated either by exceeding a number of frames in the state or by command (e.g., external command). In some configurations, the Full Refresh State may exit to the Change Adaptive State.

The Self Refresh State may enable a display to refresh itself from a local memory (in the display, for example). The Self Refresh State may additionally reduce the refresh rate since the content is known to be static. For example, the refresh rate may be reduced to a very low rate (e.g., 0.5 Hertz (Hz)) for power savings within the display. In some configurations, as with eDP 1.3, the host may command the display to enter the Self Refresh State so that the host may operate in a low power state until the host commands the display to exit the Self Refresh state. In some configurations, the Self Refresh State may exit to the Change Adaptive State.

The Motion Adaptive State may monitor frame data (e.g., incoming frame data) and control (e.g., adjust) the fraction of frames to display on the display based on a measure of activity in the scene. In some configurations, a frame skip number may control the operation of the display. The frame skip number may be varied (between 0 and 3, for example) depending on the measure of activity in the scene. In some configurations, the measure of activity in the scene may be based on the Sum of Absolute Difference (SAD) between two or more frames. Additionally, in some configurations, the measure of activity may be based on a moving average of past N–sum of absolute difference values between the two frames. In some configurations, the Motion Adaptive State may enable each frame to be subsampled and compared with a prior subsampled frame. In some cases, the Motion Adaptive State may exit by a command to enter Full Refresh or Self Refresh States. In other cases, the Motion Adaptive State may exit when many consecutive frames with difference at or below a threshold (zero, for example) are encountered. In this case, the Motion Adaptive State may exit to the Change Adaptive State.

The Change Adaptive State may monitor incoming data and set a refresh flag whenever a change (e.g., any change) is detected. In some cases, the Change Adaptive State may exit by a command to enter the Full Refresh State or Self Refresh State. In other cases, the Change Adaptive State may exit when several recent frames with a change are encountered. In this case, the Change Adaptive state may exit to the Video Adaptive State.

A possible state transition may occur following each frame. A state change may be caused either by an indication (e.g., internal command, external command) or by state change logic. Following any state change, a refresh may be indicated (RefreshFlag may be set to TRUE for one frame, for example).

A state transition may result from a transition indication or from an automatic transition condition. Transition indications (e.g., internal or external commands) may have the highest priority. An indication to enter the SELF state may have higher priority than an indication to exit the SELF state. Similarly, an indication to exit the SELF state may have higher priority than an indication to enter the FULL state. Apart from the transition indications there may be at least three automatic state transitions. The MARC state may automatically transition to the CARC state when all recent frames have zero SAD. The CARC state may automatically transition to the MARC state when more than a threshold of recent frames that have had a nonzero change are detected. The FULL state may automatically transition to the CARC state when a number of recent frames that have a small SAD exceed a threshold. It is noted that a refresh may be indicated (e.g., RefreshFlag=TRUE) each time a state transition occurs.

In some configurations, the systems and methods disclosed herein may provide the functionality of eDP 1.3 panel self-refresh and may efficiently adapt (internally, for example) the refresh behavior of a display based on the image content.

In some configurations, the host device may provide both pixel data and optionally self-refresh indications (e.g., commands). In some configurations, a touch sensor may additionally or alternatively issue an indication for full refresh operation.

In some configurations, the systems and methods disclosed herein may reside in the host device (CPU, GPU, for example). In other configurations, the systems and methods disclosed herein may reside in the display device. In some cases, the systems and methods disclosed herein may be part of a Timing Controller (TCON) module of the display device.

It is noted that in some configurations, the systems and methods disclosed herein may directly obtain touch events from a touch sensor. In other configurations, the touch sensor may send touch events to the host device. The systems and methods disclosed herein may then obtain those touch events from the host device.

The systems and methods disclosed herein may provide one or more benefits that are described as follows. In some configurations, the possible refresh states may be limited to the MARC state and the SELF state. In these configurations, the frame memory may be powered only for the SELF state. Therefore, these configurations may reduce power consumption and complexity. In other configurations, the possible refresh states may be limited to the CARC state and the SELF state. These configurations may be beneficial because no SAD calculation logic or buffers may be needed. Therefore, these configurations may reduce complexity and power consumption.

In some configurations, the systems and methods disclosed herein may be based on SAD only. For instance, the refresh rates may be controlled based on SAD only. In other configurations, the systems and methods disclosed herein may be based on frame change data only. In yet other configurations, the systems and methods disclosed herein may be based on a combination (e.g., mixture) of SAD and frame change data. For example, in some configurations, the MARC state may be based on SAD while the CARC state may be based on frame change data. Each of these configurations may be beneficial for reducing power consumption and complexity.

In some configurations, no specific video buffer may be needed. Instead, subsamples from the frame buffer may be used as needed. This may be beneficial because even though the frame memory may not be powered down, no additional video memory may be needed and the processing requirements for motion detection may be reduced by operating at the subsampled resolution. Therefore, these configurations may allow for decreased complexity and reduced power consumption.

In one example, the systems and methods disclosed herein may be located within the display module itself. In this example, the systems and methods disclosed herein may combine external commands provided outside of the display module with internal display refresh rate control.

In another example, the systems and methods disclosed herein may measure the motion activity to determine periods when the refresh rate may be reduced even though the image data is changed slightly. Adjusting a refresh rate based on a measure of motion activity may be combined with the self refresh functionality discussed previously. It is noted that in some configurations, the systems and methods disclosed herein may utilize two or more states and transitions between those states to adapt the refresh behavior (e.g., refresh rates). In some configurations, the systems and methods disclosed herein may monitor image content to control the refresh characteristics of a display device.

In another example, the systems and methods disclosed herein may provide visibility into the display module. For example, the systems and methods disclosed herein may regulate panel addressing.

In yet another example, the systems and methods disclosed herein may be located within the display itself. In some cases, the display device that includes the systems and methods disclosed herein may not be driven regularly and may not be a bi-stable or self-refreshing display. However, the systems and methods disclosed herein may adapt the refresh behavior of the display device. For example, if the display device (with a significant hold time, for example) may hold an image for a finite time (e.g., 2 seconds), then the systems and methods disclosed herein may refresh the display at a moderate refresh rate even in the absence of changes to accommodate the hold time of the display.

Various configurations are now described with reference to the Figures, where like reference numbers may indicate functionally similar elements. The systems and methods as generally described and illustrated in the Figures herein could be arranged and designed in a wide variety of different configurations. Thus, the following more detailed description of several configurations, as represented in the Figures, is not intended to limit scope, as claimed, but is merely representative of the systems and methods.

FIG. 1 is a block diagram illustrating an example of an electronic device 102 in which systems and methods for adapting refresh behavior may be implemented. The electronic device 102 may include a difference detection module 104 and a refresh module 112. The difference detection module 104 may include a difference detector 106 and a frame memory 108 for detecting differences between two or more frames 110. The refresh module 112 may include an adaptive state 114, a Self Refresh (SELF) state 116 and a state determination module 118 for adapting refreshing behavior based on the content of the frames 110. Examples of the adaptive state include the Change Adaptive State and the Motion Adaptive State described above. Each of the elements included within the electronic device 102 (e.g., the difference detection module 104 and difference detector 106) may be implemented in hardware, software or a combination of both.

The difference detector 106 may obtain one or more frames 110 (e.g., incoming frames) as an input and may send a difference indicator 120 based on the one or more frames 110 as an output. In some cases, the one or more frames 110 may come as a continuous stream. In other cases, the one or more frames 110 may come at irregular intervals. The difference detector 106 may detect any difference between a prior stored frame (stored in the frame memory 108, for example) and a subsequent frame. In some configurations, full frames (e.g., frames 110) with all the pixels in the frames may be stored in the frame memory 108. In another configuration, subsampled frames (e.g., frames 110) with fewer pixels than a full frame may be stored in the frame memory 108. In yet another configuration, compressed frames (e.g., frames 110) corresponding to full frames may be stored in the frame memory 108. The compression used may be lossless compression or lossy compression. For instance, the change or difference detection and/or SAD calculations described herein may be applied to compressed frames in some configurations.

In one example, the difference detector 106 may store a first frame 110 in the frame memory 108 (after comparing it with a previous frame 110, for example). The difference detector 106 may then obtain a second (e.g., subsequent) frame 110 and detect any differences between the second frame 110 and the first frame 110. If a difference exists between a first frame 110 and a second frame 110, then the difference detector 106 may indicate (via difference indicator 120, for example) that a difference has occurred. If a difference does not exist between the first frame 110 and the second frame 110 then the difference detector 106 may indicate (via difference indicator 120, for example) that no difference has occurred. The adaptive state 114 and the state determination module 118 may obtain the difference indicator 120.

The difference detection module 104 may output frame data 151. Examples of frame data 151 include full frames and sub-sampled frames. In some cases, frame data 151 may be provided from the frame memory 108. In other cases, frame data 151 may be a passed through version of the frames 110. For example, during a SELF state 116 (signaled by a host to the electronic device 102 (e.g., display module), for instance) the frame data 151 may be provided by the frame memory 108 (while the host stops providing frames 110, for example). During the adaptive state 114, the frame data 151 may be the frames 110 (while a host is providing frames 110, for example).

The refresh module 112 may adapt refresh behavior based on two or more operating states. For example (as illustrated in FIG. 1), the refresh module 112 may operate according to the adaptive state 114 or may operate according to the SELF state 116. Each state may output a refresh indicator 124*a-b* for indicating refresh behavior based on the state. In some configurations, the refresh module 112 may additionally include a switch 153 for outputting the refresh indicator 124 of the current operating state. For example, if the refresh module 112 is operating according to the adaptive state 114, then the switch 153 will output any refresh indications 124 indicated by the adaptive state 114. In some configurations, the switch 153 may be a hardware switch (e.g., for switching between bit level signals, electrical signals, etc.). In other configurations, the switch 153 may be a software switch (e.g., for switching between processes, lines of code, algorithms, etc.). In some configurations, the switch 153 may be controlled by the state determination module 118.

The refresh module 112 may obtain a difference indicator 120 and one or more indications 122 as inputs and may output the appropriate refresh indicator 124 based on an operating state (e.g., adaptive state 114, SELF state 116), the difference indicator 120 and the one or more indications 122.

The adaptive state 114 may obtain the difference indicator 120 as an input and may adapt refresh behavior (via a refresh indicator 124, for example) based on the difference indicator 120. For instance, the adaptive state 114 may indicate a higher refresh rate (e.g., 50 Hz) when the difference indicator 120 indicates significant differences between frames 110 and may indicate a lower refresh rate (e.g., 10 Hz) when the difference indicator 120 indicates insignificant differences between frames 110. Additionally or alternatively, the adaptive state 114 may only indicate a refresh (via the refresh indicator 124, for example) when a difference between frames 110 is detected. The SELF state 116 may adapt refresh behavior (via the refresh indicator 124, for example) based on a static frame (stored in local memory, for example) and the hold time of a display. The refresh flag described above may be one example of the refresh indicator 124.

The state determination module 118 may determine which state the refresh module 112 should be operating according to. The state determination module 118 may obtain the difference indicator 120 and the one or more indications 122 as inputs for determining which state to operate according to. For example, the state determination module 118 may determine that the refresh module 112 should operate according to the SELF state 116 based on an indication 122 (e.g., an internal or external command) to operate in the SELF state 116. As another example, the state determination module 118 may determine that the refresh module 112 should operate according to the adaptive state 114 based on differences indicated by the difference indicator 120.

Figure 2:
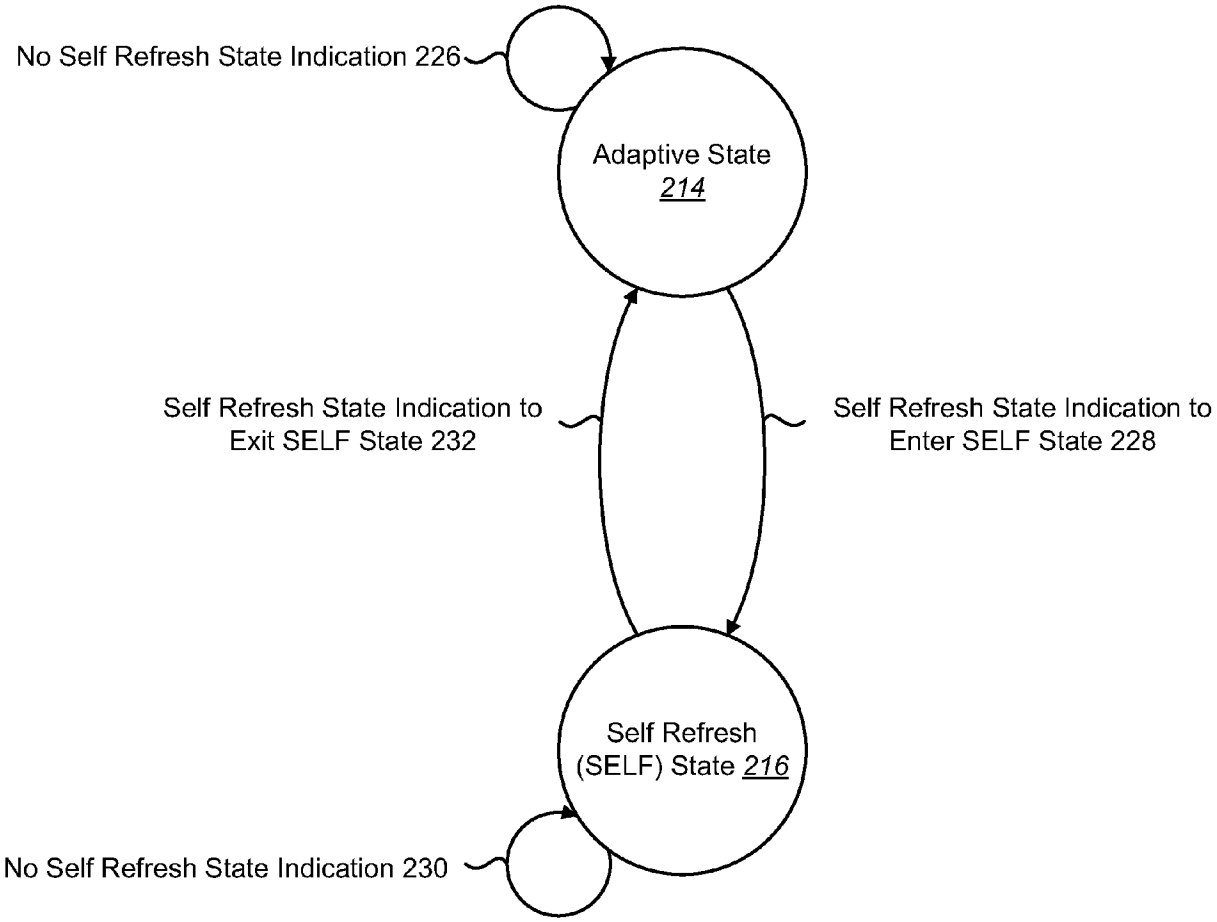

FIG. 2 is a state diagram illustrating an adaptive state 214 and a SELF state 216 that the electronic device 102 may operate according to. In some configurations (as illustrated in FIG. 2), the electronic device 102 may only operate according to either an adaptive state 214 or a SELF state 216. In other configurations, the electronic device 102 may operate according to one or more additional states.

In some configurations, the state determination module 118 may control the transitions between the various states. The state determination module 118 may determine if a state transition will occur following each frame 110. It is noted that a possible state transition may occur following each frame. For example, the state determination module 118 may cause the refresh module 112 to transition from operating in the SELF state 216 to operation in the adaptive state 214 following a first frame 110 when the state determination module 118 obtains a self refresh state indication (to exit the SELF state 216, for example). It should be noted that an indication 122 (e.g., self refresh state indication) may be an indication to enter a particular state or may be an indication to exit a particular state. For example, a first self refresh state indication 228 may be an indication to enter the SELF state 216 and a second self refresh state indication 232 may be an indication to exit the SELF state 216. It should be noted that although the terms "first" and "second" are used to distinguish types of self refresh state indications, the first and second self refresh state indications may occur in any order and may not necessarily occur in any particular sequence.

The refresh module 112 may operate in the adaptive state 214 until the state determination module 118 determines that the refresh module 112 should operate in a different state. When operating in the adaptive state 214, the state determination module 118 may monitor the indications 122 for a self refresh state indication (to enter the SELF state 216, for example). If a self refresh state indication has not been obtained, the state determination module 118 may direct the refresh module 112 to continue 226 operating according to the adaptive state 214. It should be noted that the electronic device 102 may output frame data 151 based on the passed through frames 110 during the adaptive state 214. If a self refresh state indication has been obtained, the state determination module 118 may direct the refresh module 112 to transition 228 from operating according to the adaptive state 214 to operating according to the SELF state 216.

The refresh module 112 may operate in the SELF state 216 until the state determination module 118 determines that that the refresh module 112 should operate in a different state. When operating in the SELF state 216, the state determination module 118 may monitor the indications 122 for a self refresh state indication (to exit the SELF state 216, for example). If a self refresh state indication has not been obtained, the state determination module 118 may direct the refresh module 112 to continue 230 operating according to the SELF state 216. It should be noted that the electronic device 102 may output frame data 151 based on the frame memory 108 during the SELF state 216 (until a signal (e.g., self refresh state indication) is sent to exit the SELF state 216, for example). If a self refresh state indication has been obtained, the state determination module 118 may direct the refresh module 112 to transition 232 from operating according to the SELF state 216 to operating according to the adaptive state 214.

It is noted that in some configurations, the adaptive state 214 may be a change adaptive state (discussed below). Additionally or alternatively, the adaptive state 214 may be a motion adaptive state (discussed below).

Figure 3:
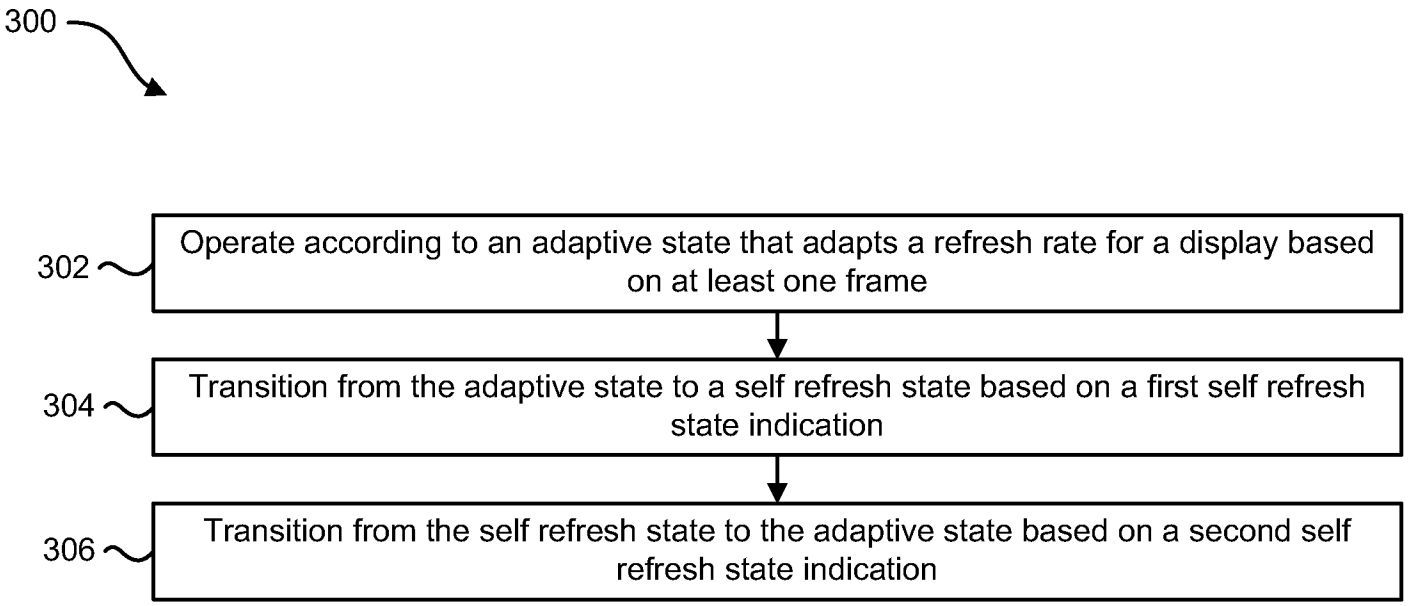
FIG. 3 is a flow diagram illustrating one configuration of a method for adapting refresh behavior on an electronic device.

FIG. 3 is a flow diagram illustrating one configuration of a method 300 for adapting refresh behavior on an electronic device 102. The electronic device 102 may operate 302 according to an adaptive state (e.g., adaptive state 114, 214) that adapts a refresh rate for a display based on at least one frame. Examples of the adaptive state include a change adaptive state and a motion adaptive state. More detail is given below on the change adaptive state (as discussed below in connection with FIG. 6, for example) and the motion adaptive state (as discussed below in connection with FIG. 7, for example). In some configurations, operating according to an adaptive state may include adapting the refresh rate based on a difference between two or more frames 110. For example, when operating according to the adaptive state, the electronic device 102 may indicate a refresh each time a difference between two frames 110 exceeds a threshold (e.g., 0, 10%, 20%, etc.).

The electronic device 102 may transition 304 from the adaptive state to a self refresh state (e.g., SELF state 116, 216) based on a first self refresh state indication. For example, the electronic device 102 may transition 304 from the adaptive state to the SELF state immediately following the frame 110 during which the self refresh state indication is received (e.g., upon obtaining or receiving a self refresh state indication 228). In some configurations, a refresh may be indicated for each transition.

The electronic device 102 may transition 306 from the self refresh state to the adaptive state based on a second self refresh state indication. For example, the electronic device 102 may transition 306 (e.g., transition 232) from the SELF state to the adaptive state immediately following the frame 110 when a self refresh state indication to exit the SELF state is obtained. In some configurations, a refresh may be indicated for each transition.

Figure 4:
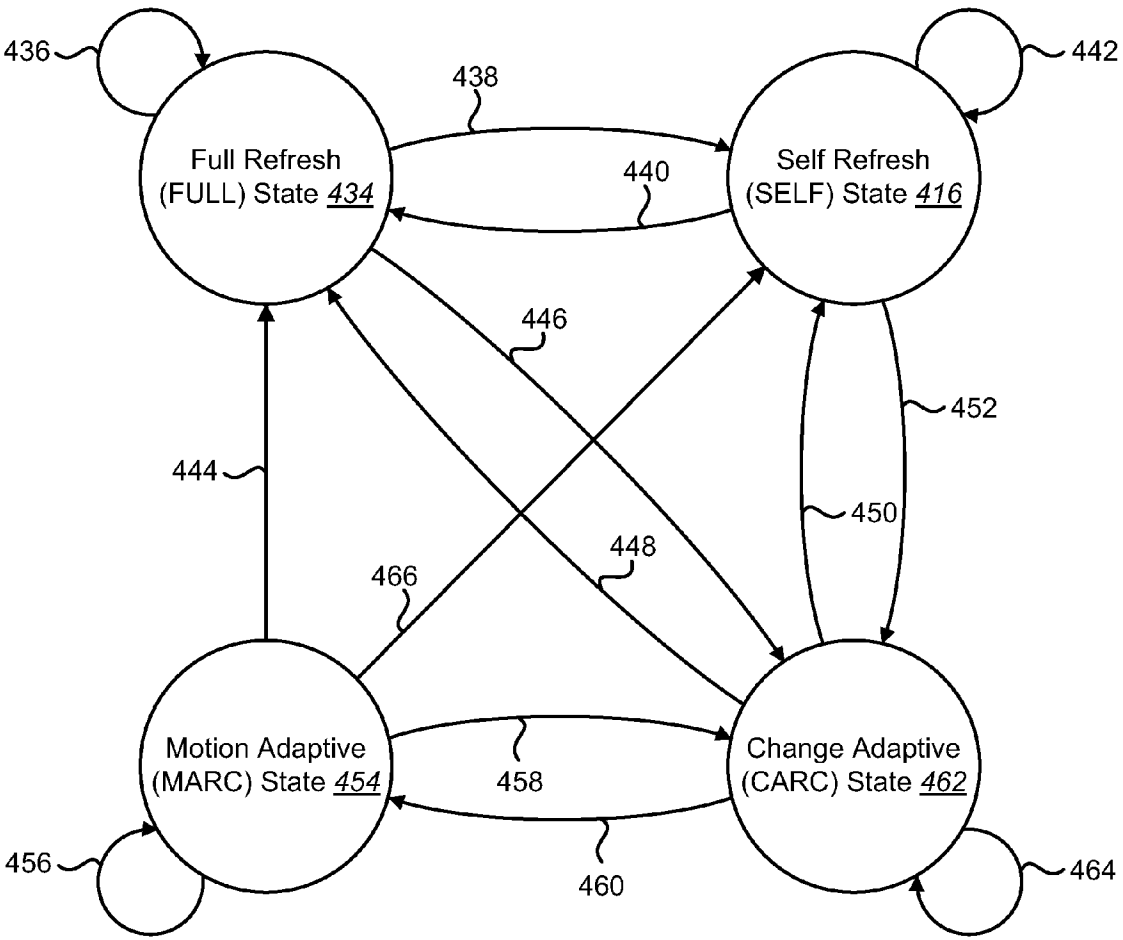
FIG. 4 is a state diagram illustrating one configuration of operating states for adapting refresh behavior on an electronic device.

FIG. 4 is a state diagram illustrating one configuration of operating states for adapting refresh behavior on an electronic device 102. In some configurations (as illustrated in FIG. 4), the electronic device 102 may operate according to a FULL state 434, a SELF state 416, a MARC state 454 or a CARC state 462. In some configurations (not shown), the electronic device 102 may operate according to additional or alternative states.

In some configurations, the state determination module 118 may control the transitions between the various states. The state determination module 118 may determine if a state transition will occur. It is noted that a possible state transition may occur following each frame. For example, the state determination module 118 may cause the refresh module 112 to transition from operating according to the SELF state 416 to operation according to the CARC state 462 following a first frame 110 when the state determination module 118 obtains a self refresh state indication to exit the SELF state 416. It should be noted that an indication (e.g., self refresh state indication, full refresh indication) may be an indication to enter a particular state or may be an indication to exit a particular state.

The refresh module 112 may operate in the CARC state 462 until the state determination module 118 determines that the refresh module 112 should operate in a different state. When operating in the CARC state 462, the state determination module 118 may monitor any indications 122 for a self refresh state indication or a full refresh state indication. Additionally, the state determination module 118 may monitor the difference indicator 120 for determining whether the differences between two or more frames exceeds a threshold. In some configurations, the differences between two or more frames may be determined based on a SAD calculation. For example, determining whether the differences between two or more frames exceeds a threshold may comprise determining whether a number of large SAD frames (e.g., frames with large SAD values) exceeds a threshold (five large SAD frames, for example). In some cases, the size of a SAD value may be relative to the image resolution. For example, for an image resolution of 1024×600, a SAD value of 40,000 may be a 'small' SAD value. The SAD value may be higher for a high resolution display. It should be noted that a 'large' SAD value may be greater than a 'small' SAD value.

If none of these conditions occur (self refresh state indication, full refresh state indication or differences between frames that exceeds a threshold) then the state determination module 118 may direct the refresh module 112 to continue 464 operating according to the CARC state 462. If a full refresh state indication (to enter the FULL state 434, for example) is obtained, then the state determination module 118 may direct the refresh module 112 to transition 448 from operating according to the CARC state 462 to operating according to the FULL state 434. If a self refresh state indication (to enter the SELF state 416, for example) is obtained, then the state determination module 118 may direct the refresh module 112 to transition 450 from operating according to the CARC state 462 to operating according to the SELF state 416. If a difference between frames exceeds a threshold (the number of large SAD frames is greater than a threshold, for example), then the state determination module 118 may direct the refresh module 112 to transition 460 from operating according to the CARC state 462 to operating according to the MARC state 454. It is noted that the transition 460 from the CARC state 462 to the MARC state 454 may be an automatic transition (may transition without any user interaction, for example). Examples of operation according to the CARC state 462 are provided above and will be discussed in additional detail in conjunction with FIG. 6 below.

The refresh module 112 may operate in the MARC state 454 until the state determination module 118 determines that the refresh module 112 should operate in a different state. When operating in the MARC state 454, the state determination module 118 may monitor any indications 122 for a self refresh state indication or a full refresh state indication. Additionally, the state determination module 118 may monitor the difference indicator 120 for determining whether the differences between two or more frames exceeds a threshold. In some configurations, the differences between two or more frames may be determined based on a SAD calculation. For example, determining whether the differences between two or more frames exceeds a threshold may comprise determining whether a number of SAD zero frames (e.g., frames with a SAD value of zero) exceeds a threshold (five SAD zero frames, for example). If none of these conditions occur (self refresh state indication, full refresh state indication or differences between frames that exceeds a threshold) then the state determination module 118 may direct the refresh module 112 to continue 456 operating according to the MARC state 454. If a full refresh state indication is obtained, then the state determination module 118 may direct the refresh module 112 to transition 444 from operating according to the MARC state 454 to operating according to the FULL state 434. If a self refresh state indication is obtained, then the state determination module 118 may direct the refresh module 112 to transition 466 from operating according to the MARC state 454 to operating according to the SELF state 416. If a difference between frames exceeds a threshold (the number of SAD zero frames is greater than a threshold, for example), then the state determination module 118 may direct the refresh module 112 to transition 458 from operating according to the MARC state 454 to operating according to the CARC state 462. It is noted that the transition 458 from the MARC state 454 to the CARC state 462 may be an automatic transition (may transition without any user interaction, for example). Examples of operation according to the MARC state 454 are provided above and will be discussed in additional detail in conjunction with FIG. 7 below.

The refresh module 112 may operate in the FULL state 434 until the state determination module 118 determines that the refresh module 112 should operate in a different state. When operating in the FULL state 434, the state determination module 118 may monitor any indications 122 for a self refresh state indication. Additionally, the state determination module 118 may monitor the difference indicator 120 for determining whether the differences between two or more frames exceeds a threshold. In some configurations, the differences between two or more frames may be determined based on a SAD calculation. For example, determining whether the differences between two or more frames exceeds a threshold may comprise determining whether a number of small SAD frames (e.g., frames with a small SAD value) exceeds a threshold (five small SAD frames, for example). In some cases (for a display with 1024×600 resolution, for example), a SAD value of 40,000 may be a 'small' SAD value. It should be noted that the 'small' SAD value may need to be higher for a high resolution display.

If none of these conditions occur (self refresh state indication or differences between frames that exceeds a threshold) then the state determination module 118 may direct the refresh module 112 to continue 436 operating according to the FULL state 434. If a self refresh state indication is obtained, then the state determination module 118 may direct the refresh module 112 to transition 438 from operating according to the FULL state 434 to operating according to the SELF state 416. If a difference between frames exceeds a threshold (the number of small SAD frames is greater than a threshold, for example), then the state determination module 118 may direct the refresh module 112 to transition 446 from operating according to the FULL state 434 to operating according to the CARC state 462. It is noted that the transition 446 from the FULL state 434 to the CARC state 462 may be an automatic transition (may transition without any user interaction, for example). Examples of operation according to the FULL state 434 are provided above and will be discussed in additional detail in conjunction with FIG. 9 below.

The refresh module 112 may operate in the SELF state 416 until the state determination module 118 determines that the refresh module 112 should operate in a different state. When operating in the SELF state 416, the state determination module 118 may monitor any indications 122 for a full refresh state indication. Additionally, the state determination module 118 may monitor the difference indicator 120 for determining whether a difference between frames occurs. In some configurations, the difference between frames may be any difference that occurs between an incoming frame and a static frame that may be used for SELF state refreshes. If neither of these conditions occur (full refresh state indication or differences between frames), then the state determination module 118 may direct the refresh module 112 to continue 442 operating according to the SELF state 416. If a full refresh state indication is obtained, then the state determination module 118 may direct the refresh module 112 to transition 440 from operating according to the SELF state 416 to operating according to the FULL state 434. If a self refresh state indication is obtained (to exit the SELF state 416), then the state determination module 118 may direct the refresh module 112 to transition 452 from operating according to the SELF state 416 to operating according to the CARC state 462. In some configurations, operating according to the SELF state 416 comprises setting the some or all of the host device (e.g., Graphics Processing Unit (GPU)) to a sleep state. Examples of operation according to the SELF state 416 are provided above and will be discussed in additional detail in conjunction with FIG. 8 below.

Figure 5:
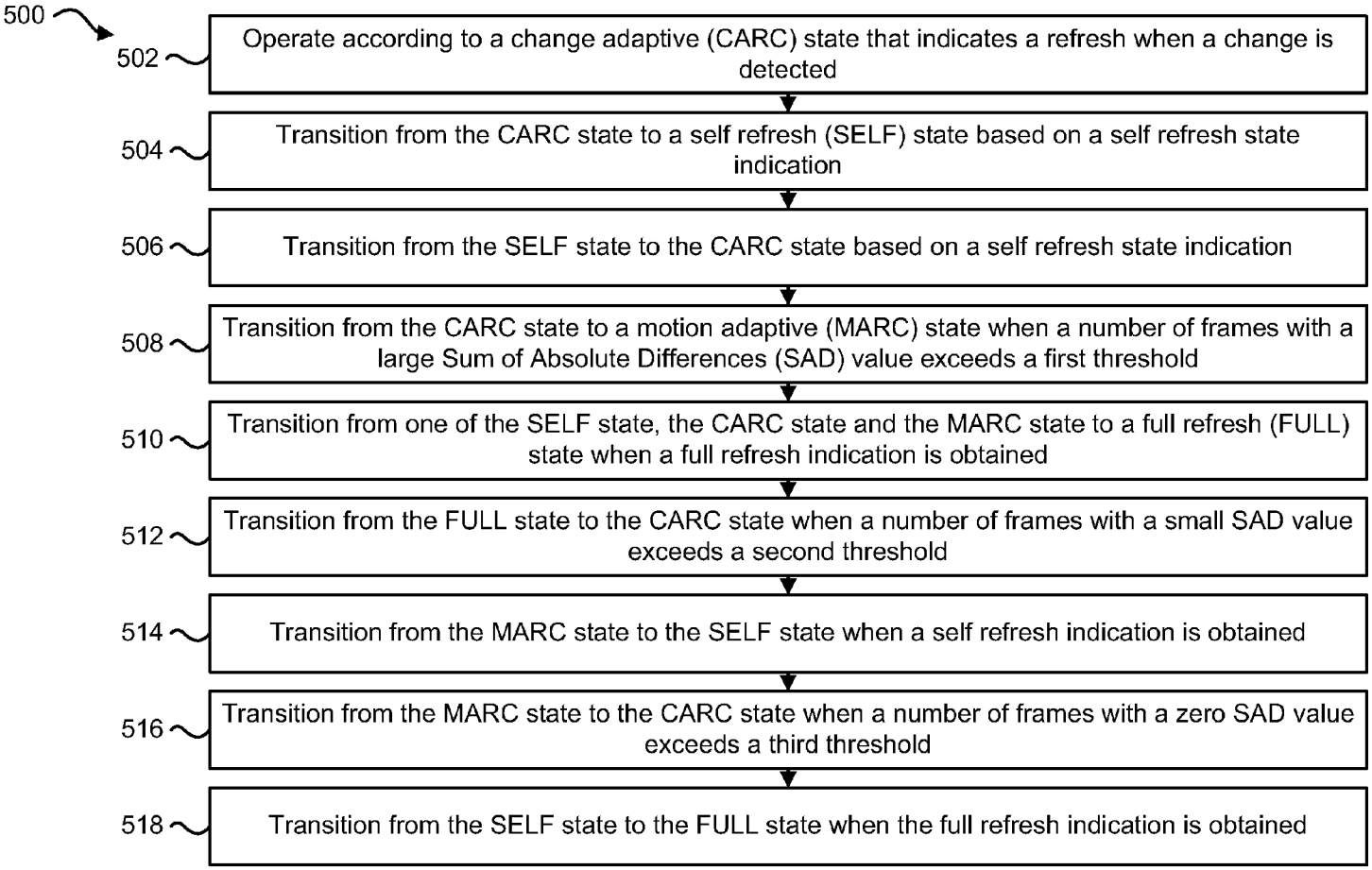
FIG. 5 is a flow diagram illustrating another configuration of a method for adapting refresh behavior on an electronic device.

FIG. 5 is a flow diagram illustrating another configuration of a method 500 for adapting refresh behavior on an electronic device 102. The electronic device may operate 502 according to a CARC state (e.g., CARC state 462) that indicates a refresh based on a change between frames. Operating 502 according to a CARC state may be similar to operating according to an adaptive state discussed previously.

It should be noted that in some implementations and/or in some states, the electronic device 102 may detect a difference or change between at least two frames. For example, the electronic device 102 may detect a difference between frames based a Sum of Absolute Difference (SAD) between at least two frames. In some configurations, the difference detection may be applied to one or more states of operation and/or for transitioning between states.

The electronic device 102 may transition 504 (e.g., transition 228, 450) from the CARC state to a SELF state (e.g., SELF state 116, 216, 416) based on a (first) self refresh state indication. For example, the electronic device 102 may transition 504 from the CARC state to the SELF state immediately following the frame 110 during which the self refresh state indication is obtained. In some configurations, a refresh may be indicated for each transition described herein.

The electronic device 102 may transition 506 (e.g., transition 232, 452) from the SELF state to the CARC state based on a (second) self refresh state indication. For example, the electronic device 102 may transition 506 from the SELF state to the CARC state immediately following the frame 110 during which the self refresh state indication is obtained.

The electronic device 102 may transition 508 (e.g., transition 460) from the CARC state to the MARC state when a number of large SAD frames exceeds a first threshold. For example, the electronic device 102 may transition 508 from the CARC state to the MARC state immediately (and automatically, for example) when it is determined that a number of large SAD frames exceeds the first threshold.

The electronic device 102 may transition 510 (e.g., one of transitions 438, 448, 444) from one of the SELF state, CARC state and MARC state to a FULL state when a full refresh state indication is obtained (e.g., received). The electronic device 102 may transition 512 (e.g., transition 446) from the FULL state to the CARC state when a number of small SAD frames exceeds a second threshold. The electronic device 102 may transition 514 (e.g., transition 466) from the MARC state to the SELF state when a (first) self refresh state indication is obtained. The electronic device 102 may transition 516 (e.g., transition 458) from the MARC state to the CARC state when a number of zero SAD frames exceeds a third threshold. The electronic device 102 may transition 518 (e.g., transition 440) from the SELF state to the FULL state when the full refresh indication is obtained. In some configurations and/or instances, the full refresh indication may be based on touch information (e.g., a touch event or touch information issued from a touch sensor).

Figure 6:
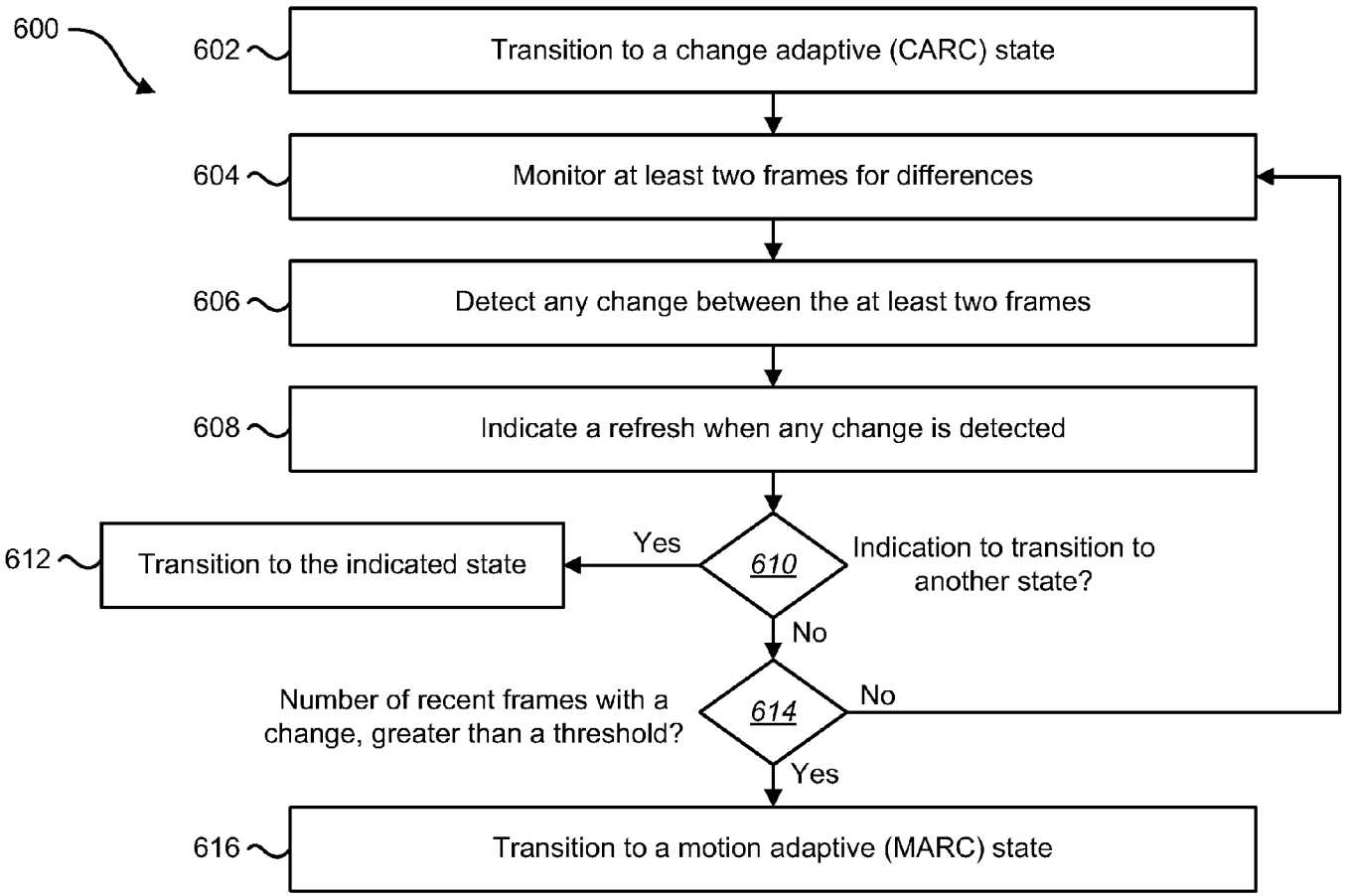
FIG. 6 is a flow diagram illustrating one configuration of a method for operating according to a change adaptive (CARC) state and for transitioning to and from the CARC state.

FIG. 6 is a flow diagram illustrating one configuration of a method 600 for operating according to a change adaptive (CARC) state and for transitioning to and from the CARC state. The electronic device 102 may transition 602 to a CARC state. For example, the electronic device 102 may transition 602 to the CARC state via one of the transitions (e.g., transition 458, 446, 452 or 464) discussed previously.

The electronic device 102 may monitor 604 at least two frames (e.g., incoming frames) for differences. The electronic device 102 may detect 606 any change between the at least two incoming frames. In some configurations, a change may be detected based on a SAD calculation. In other configurations, a change may be detected if two frames are not identical (a single pixel value is different, for example). The electronic device 102 may indicate 608 a refresh when any change is detected. For example, indicating 608 a refresh may comprise sending an indicator (e.g., a flag) that indicates that a display should be refreshed. In some configurations, the electronic device 102 may indicate 608 a refresh using the refresh indicator 124 discussed previously with respect to FIG. 1.

The electronic device 102 may determine 610 if an indication to transition to another state has been obtained. If an indication to transition to another state has been obtained, then the electronic device 102 may transition 612 to the indicated state. For example, if a self refresh state indication (indicating an entrance command, for example) is obtained, then the electronic device 102 may transition 612 to the SELF state. If an indication to transition to another state has not been obtained, then the electronic device 102 may determine 614 if a number of recent frames with a change is greater than a threshold. If the number of recent frames with a change is less than or equal to the threshold, then the electronic device 102 may loop back to monitoring 604 at least two incoming frames for differences. If the number of recent frames with a change is greater than a threshold, then the electronic device 102 transitions 616 to a motion adaptive MARC state. It is noted that an indication to transition to another state may be prioritized as compared with an automatically determined transition (e.g., based on comparing a metric with a threshold).

Figure 7:
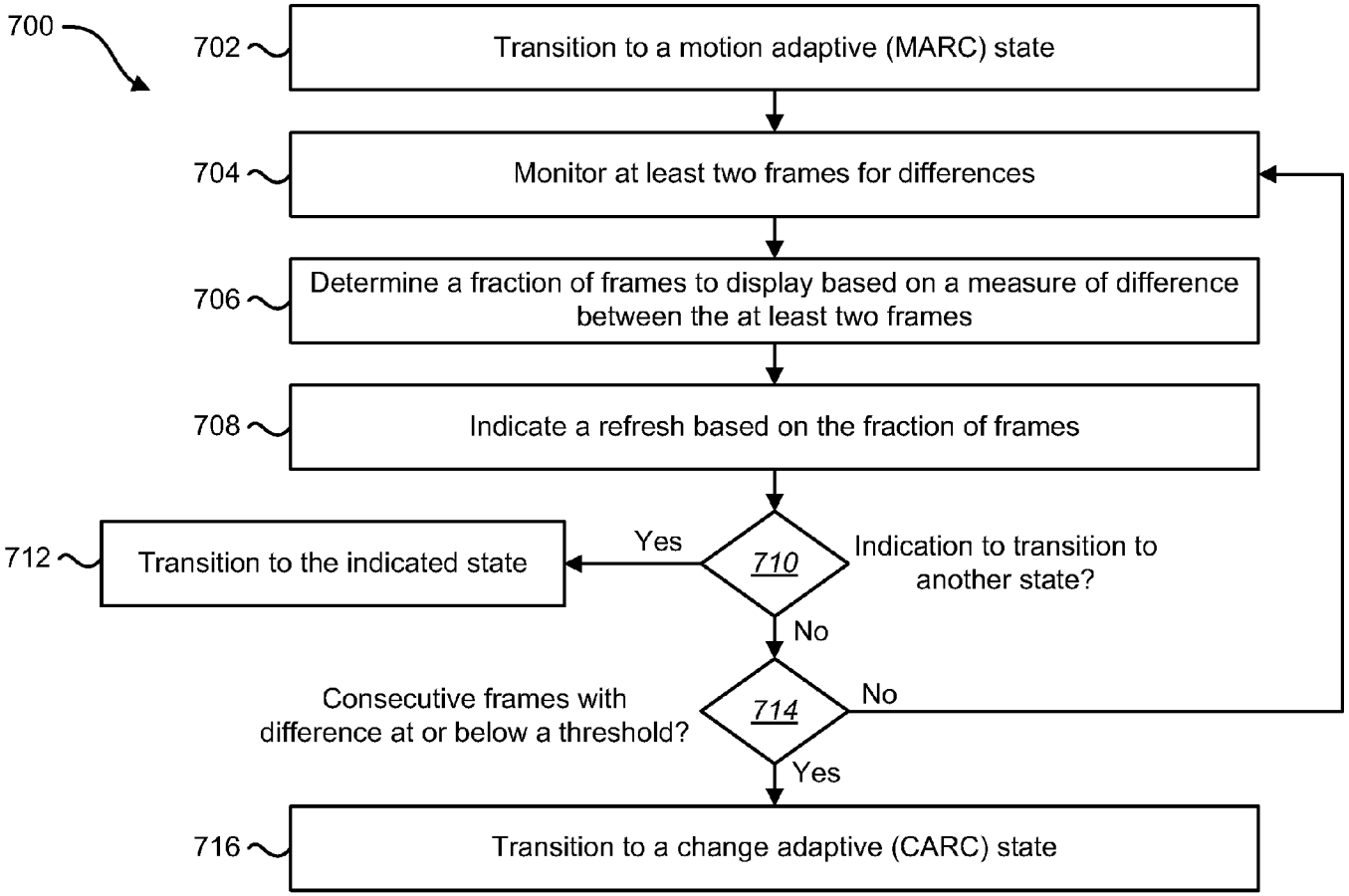
FIG. 7 is a flow diagram illustrating one configuration of a method for operating according to a motion adaptive (MARC) state and for transitioning to and from the MARC state.

FIG. 7 is a flow diagram illustrating one configuration of a method 700 for operating according to a motion adaptive (MARC) state and for transitioning to and from the MARC state. The electronic device 102 may transition 702 to a MARC state. For example, the electronic device 102 may transition 702 to the MARC state via one of the transitions (e.g., transition 460 or 456) discussed previously.

The electronic device 102 may monitor 704 at least two frames (e.g., incoming frames) for differences. The electronic device 102 may determine 706 a fraction of frames to display based on a measure of difference between the at least two incoming frames. For example, if there is very little change between a first and a fourth frame and more significant changes in a fifth frame, then the electronic device 102 may determine to skip the second frame through the fourth frame and only display the first frame and the fifth frame. Therefore, in one configuration, the first frame may be displayed until it is refreshed with the fifth frame. The electronic device 102 may indicate 708 a refresh based on the fraction of frames. For instance (continuing with the previous example), the electronic device 102 may indicate a refresh for the first frame and for the fifth frame. The remaining frames (the second through fourth frames, for example) may be skipped. In some configurations, indicating 708 a refresh may comprise sending an indicator (e.g., a flag) that indicates that a display should be refreshed. In some configurations, the electronic device 102 may indicate 708 a refresh using the refresh indicator 124 discussed previously with respect to FIG. 1.

The electronic device 102 may determine 710 if an indication to transition to another state has been obtained. If an indication to transition to another state has been obtained then the electronic device 102 may transition 712 to the indicated state. For example, if a self refresh state indication (indicating an entrance command, for example) is obtained, then the electronic device 102 may transition 712 to the SELF state. If an indication to transition to another state has not been obtained, then the electronic device 102 may determine 714 if a number (e.g., threshold number) of recent frames have differences at or below a threshold. If the number of recent frames do not have differences less than or equal to the threshold, then the electronic device 102 may loop back to monitoring 704 at least two incoming frames for differences. If the number of recent frames have differences less than or equal to the threshold, then the electronic device 102 transitions 716 to a CARC state. It is noted that an indication to transition to another state may be prioritized as compared with an automatically determined transition (e.g., based on comparing a metric with a threshold).

Figure 8:
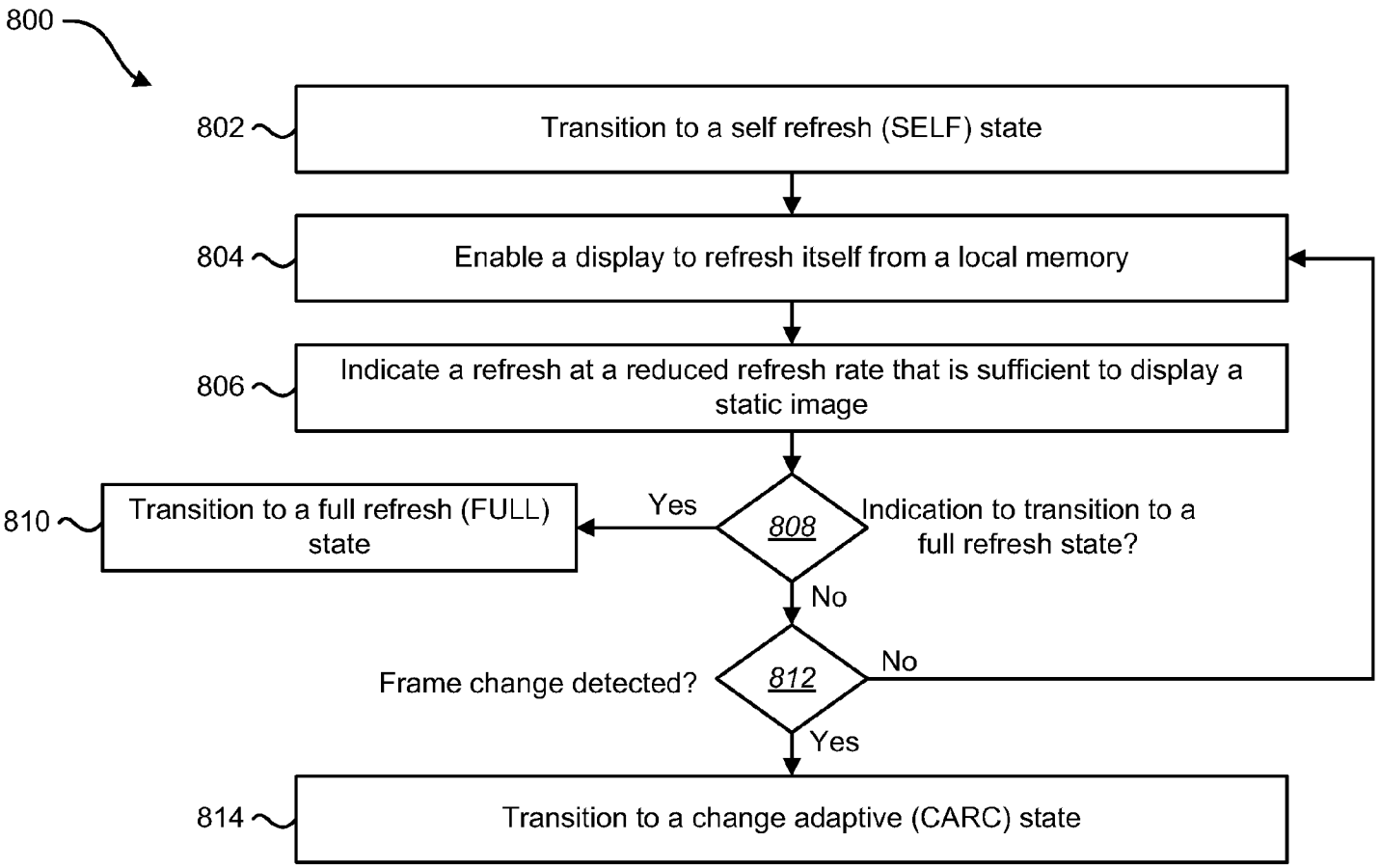
FIG. 8 is a flow diagram illustrating one configuration of a method for operating according to a self refresh (SELF) state and for transitioning to and from the SELF state.

FIG. 8 is a flow diagram illustrating one configuration of a method 800 for operating according to a self refresh (SELF) state and for transitioning to and from the SELF state. The electronic device 102 may transition 802 to a SELF state. For example, the electronic device 102 may transition 802 to the SELF state via one of the transitions (e.g., transition 438, 466, 450 or 442) discussed previously.

The electronic device 102 may enable 804 a display to refresh itself from a local memory (e.g., frame memory 108). In some configurations, the electronic device 102 may provide an indication to the display to refresh itself from a local memory. It is noted that in some configurations, the electronic device 102 may continue to provide refresh indications (via refresh indicator 124, for example) to adapt the refresh behavior of the display while the display is in a self refresh mode (e.g., using a stored frame to refresh).

The electronic device 102 may indicate 806 a refresh at a reduced refresh rate that is sufficient to display a static image. It is noted that a display may have a finite hold time for an image. Therefore, a display may need to be refreshed even if there are no changes to the frame. For example, a display may hold an image for 2 seconds. In this example, even though the frame to be displayed is static (stored in local memory, for example) the electronic device 102 may indicate 806 that refreshes be performed at a reduced rate (0.5 Hz, for example). In some configurations, indicating 806 a refresh may comprise sending an indicator (e.g., a flag) that indicates that a display should be refreshed. In some configurations, the electronic device 102 may indicate 806 a refresh using the refresh indicator 124 discussed previously with respect to FIG. 1.

The electronic device 102 may determine 808 if an indication to transition to a full refresh state has been obtained. If an indication to transition to a full refresh state has been obtained, then the electronic device 102 may transition 810 to the full refresh (FULL) state. If an indication to transition to a FULL state has not been obtained, then the electronic device 102 may determine 812 if one of a self refresh state indicator (to exit the SELF state, for example) and a frame change (e.g., difference) has been detected (via difference indicator 120, for example. If a self refresh state indication has not been obtained or a frame change (any change) has not been detected, then the electronic device 102 may loop back to enabling 804 a display to refresh itself from a local memory. If a self refresh state indication has been obtained, then the electronic device 102 may transition to the CARC state. If a frame change has been detected, then the electronic device 102 may transition 814 to the CARC state. It should be noted that the self refresh state indication may have the highest priority. It should also be noted that the full refresh state indication may be prioritized over the frame change detection.

Figure 9:
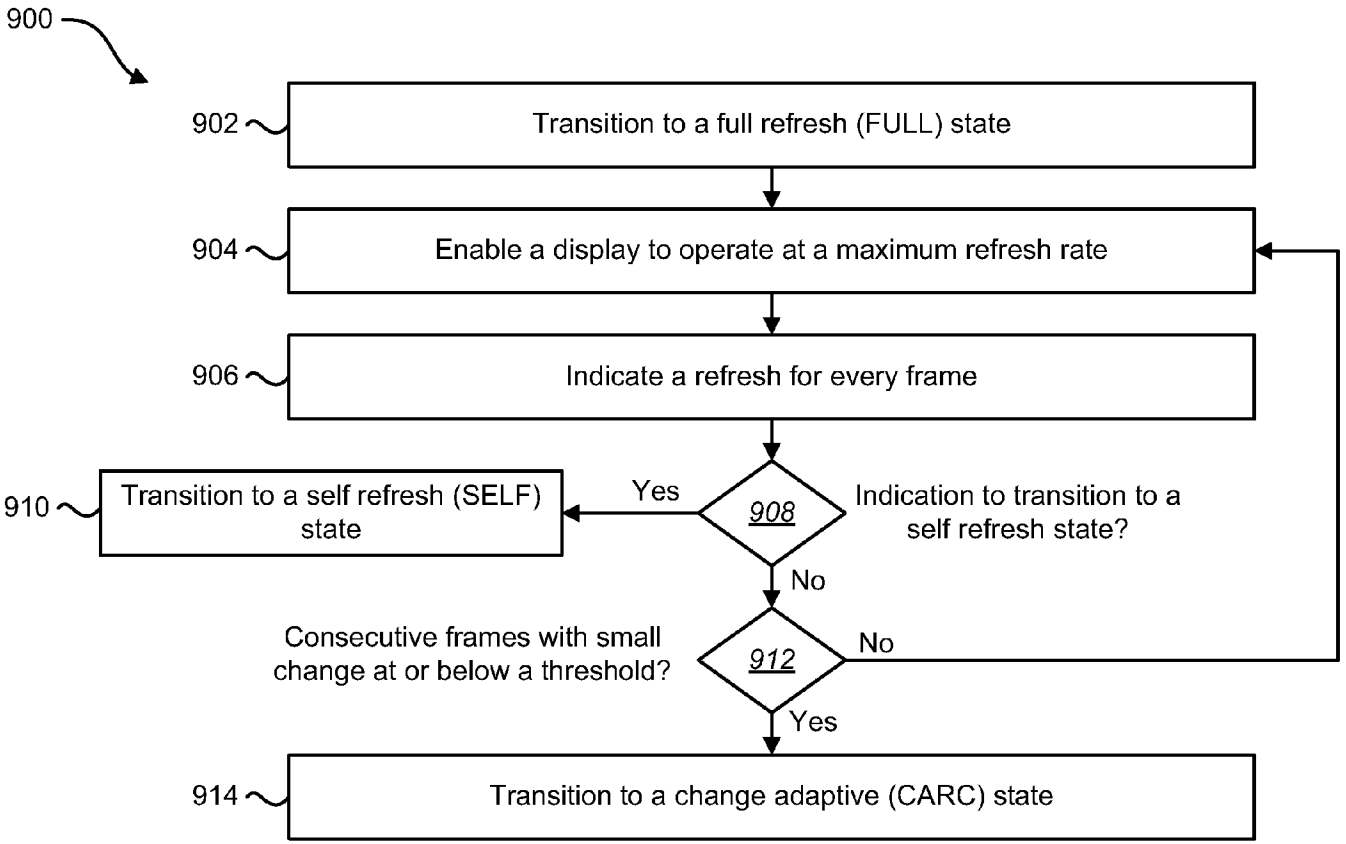
FIG. 9 is a flow diagram illustrating one configuration of a method for operating according to a full refresh (FULL) state and for transitioning to and from the FULL state.

FIG. 9 is a flow diagram illustrating one configuration of a method 900 for operating according to a full refresh (FULL) state and for transitioning to and from the FULL state. The electronic device 102 may transition 902 to a FULL state. For example, the electronic device 102 may transition 902 to the FULL state via one of the transitions (e.g., transition 444, 448, 440 or 436) discussed previously.

The electronic device 102 may enable 904 a display to operate at maximum refresh rate. In some configurations, the electronic device 102 may provide an indication to the display to refresh itself at least for each frame obtained. In other configurations, the electronic device 102 may provide the display with indications to refresh each time a refresh indication is obtained. It is noted that in some configurations, the electronic device 102 may continue to provide refresh indications (via refresh indicator 124, for example) to indicate the display to refresh. For these configurations, the electronic device 102 may indicate 906 a refresh for (at least) every frame. In some configurations, the electronic device 102 may indicate 906 a refresh using the refresh indicator 124 discussed previously with respect to FIG. 1.

The electronic device 102 may determine 908 if an indication to transition to a self refresh state has been obtained (e.g., received). If an indication to transition to a self refresh state has been obtained, then the electronic device 102 may transition 910 to the SELF state. If an indication to transition to a SELF state has not been obtained, then the electronic device 102 may determine 912 if a number of frames with small changes that are less than or equal to a threshold have been obtained. If a number of frames with small changes that are less than or equal to a threshold have not been obtained, then the electronic device 102 may loop back to enabling 904 a display to operate at a maximum refresh rate. If a number of frames with small changes that are less than or equal to a threshold have been obtained, then the electronic device 102 may transition 914 to the CARC state. It is noted that the full refresh state indication may be prioritized over the frame change detection. In some configurations, the electronic device 102 may transition 914 to the change adaptive state when a predetermined frame count in the FULL state has been exceeded.

Figure 10:
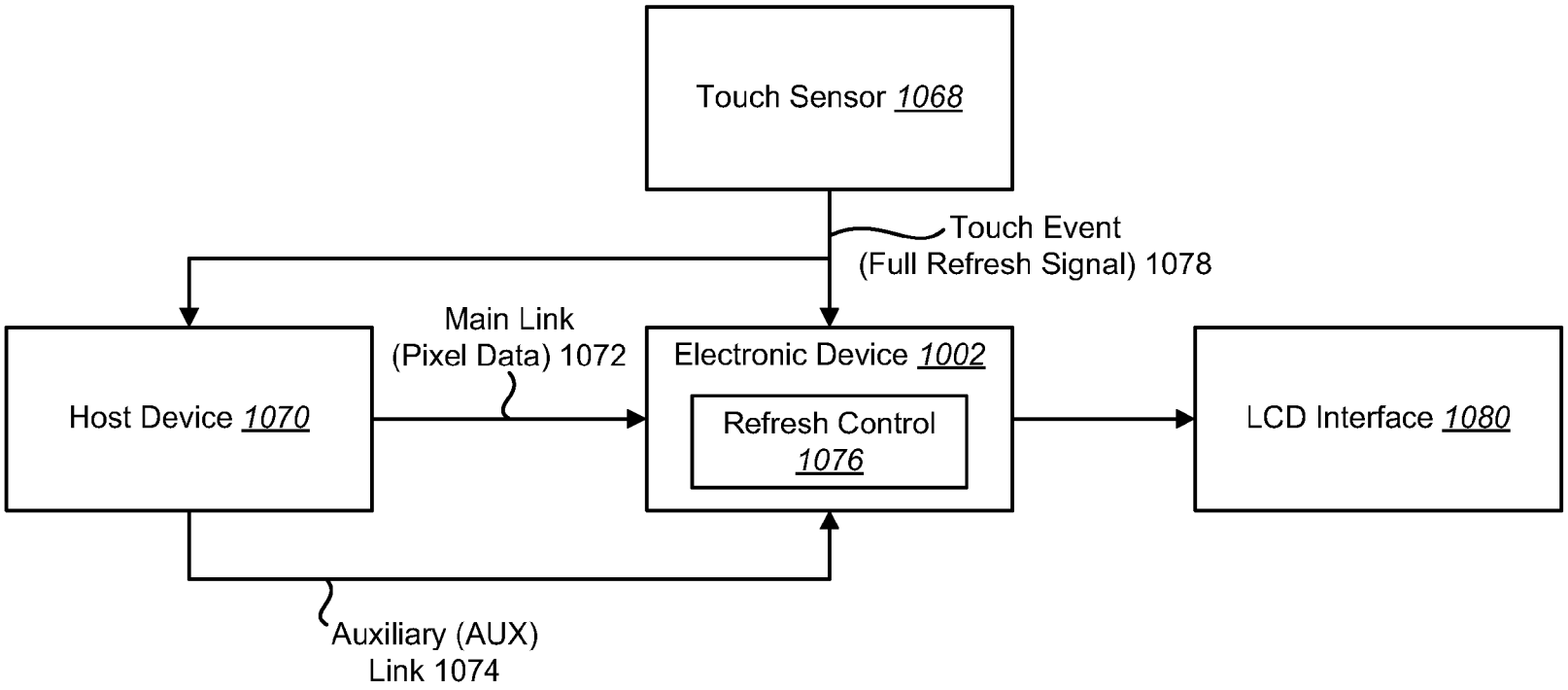
FIG. 10 is a block diagram illustrating one configuration in which an electronic device for adapting refresh behavior may be implemented.

FIG. 10 is a block diagram illustrating one configuration in which an electronic device 1002 for adapting refresh behavior may be implemented. An electronic device 1002 may control the refresh behavior of a display (via a Liquid Crystal Display (LCD) interface 1080, for example). The electronic device 1002 may receive various inputs. For example, the electronic device 1002 may receive a main link 1072 and optionally, an auxiliary link 1074 from a host device 1070. The main link 1072 may include pixel data and frame data (e.g., frames 110). In some configurations, the main link 1072 may also include auxiliary information (e.g., indications 122). In some configurations, an auxiliary link 1074 may include auxiliary information (e.g., indications 122). The electronic device 1002 may additionally receive auxiliary information (e.g., indications 122) from another device (e.g., touch sensor 1068). In one example, the touch sensor 1068 may send a touch event 1078 comprising a full refresh state indication (e.g., indication 122) directly to the electronic device 1002. In another example, the touch sensor 1068 may send a touch event 1078 comprising a full refresh state indication to the host device 1070 which may indicate the full refresh state indication via the auxiliary link 1074.

The electronic device 1002 may include a refresh control 1076 for controlling the refresh behavior for a display (via the LCD interface 1080, for example). For example, the electronic device 1002 may indicate to the refresh control 1076 (via refresh indicator 124, for example) when the refreshes should occur. The electronic device 1002 may be similar to the electronic device 102 described previously with respect to FIG. 1. The electronic device 1002 may adapt the refresh behavior of a display using the systems and methods disclosed herein. In some configurations, the electronic device 1002, the touch sensor 1068 and the LCD interface 1080 may be integrated into a single device (e.g., a display, monitor, television, touchscreen, etc.).

Figure 11:
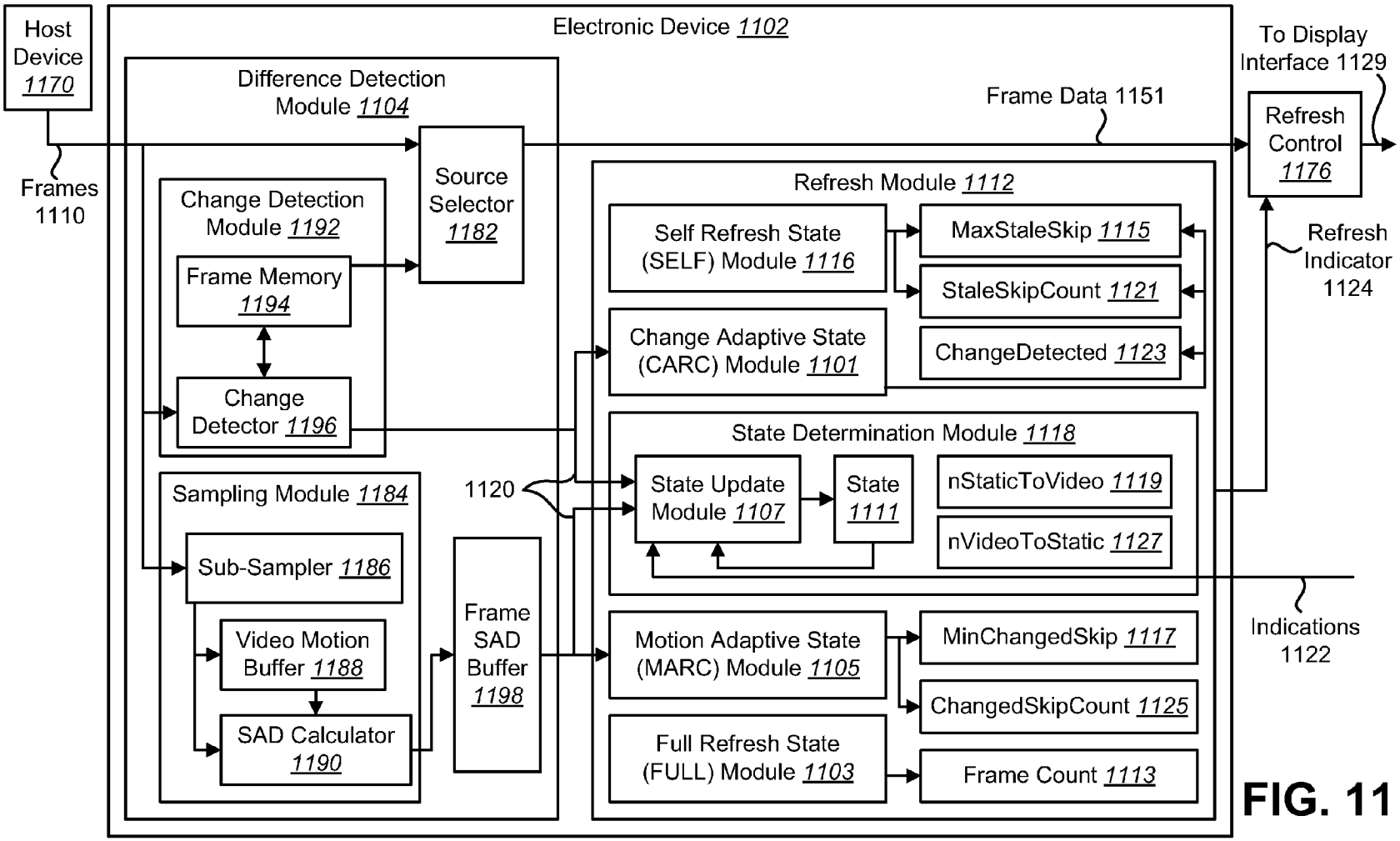
FIG. 11 is a block diagram illustrating one configuration of an electronic device in which systems and methods for adapting refresh behavior may be implemented.

FIG. 11 is a block diagram illustrating one configuration of an electronic device 1102 in which systems and methods for adapting refresh behavior may be implemented. An electronic device 1102 may include a difference detection module 1104 and a refresh module 1112. The difference detection module 1104 may be similar to the difference detection module 104 and the refresh module 1112 may be similar to the refresh module 112 described previously with respect to FIG. 1.

The difference detection module 1104 may obtain frames 1110 from a host device 1170. The host device 1170 may be similar to the host device 1070 described previously with respect to FIG. 10. The difference detection module 1104 may include a sampling module 1184 and a change detection module 1192. In some configurations, the difference detection module 1104 may include the change detection module 1192 (and not the sampling module 1184). In other configurations, the difference detection module 1104 may include the sampling module 1184 (and not the change detection module 1192).

The difference detection module 1104 may additionally include a source selector 1182. The source selector 1182 may output frame data 1151 based on the selected source. When the frame memory 1194 is selected, the frame data 1151 may be one or more static frames (e.g., full frames or sub-sampled frames) that are stored in the frame memory 1194. When the pass through source is selected, the frame data 1151 may be the frames 1110 obtained from a host device 1170. In some configurations, the source selector 1182 may provide the frame data 1151 from the frame memory 1194 during the SELF state 1116 and may provide the frame data 1151 from the pass through frames 1110 during the other states (e.g., when the FULL state module 1103, MARC state module 1105 or CARC state module 1101 is operating).

The change detection module 1192 may enable change detection between two (or more) frames 1110. The change detection module 1192 may include a change detector 1196 and a frame memory 1194. The change detector 1196 may be similar to the difference detector 106 and the frame memory 1194 may be similar to the frame memory 108 discussed previously with respect to FIG. 1. In some configurations, the change detector 1196 may detect a change by comparing a frame 1110 with a previously stored frame (stored in frame memory 1194, for example). Following a comparison, the change detection module 1192 may replace the previously stored frame with the frame 1110 (in the frame memory 1194, for example). In some cases, the frame memory 1194 may enable self refresh functionality. For example, the source selector 1182 may select a frame for display from either the incoming frames 1110 from the host device 1170 or from the frame memory 1194. Thus, the combination of the source selector 1182 and the frame memory 1194 may allow the host device 1170 to enter a sleep state while refreshing from a static frame stored in the frame memory 1194 (e.g., local memory in the electronic device 102). It is noted that this self refresh functionality may be provided with a display device that does not itself provide self refresh abilities.

The sampling module 1184 may enable change detection based on a SAD calculation with respect to two (or more) frames 1110. The sampling module 1184 may include a sub-sampler 1186, a video motion buffer 1188 and a SAD calculator 1190. The sub-sampler 1186 may subsample each frame 1110 and the SAD calculator 1190 may compare (by computing the SAD, for example) the subsampled frame with a previously subsampled frame. In some configurations, previously subsampled frames may be stored in the video motion buffer 1188. Comparing frames based on SAD may be beneficial for quantizing the amount of change between two frames. It should be noted that in some configurations, difference determination may be based exclusively on either the sampling module 1184 or the change detection module 1192. In other configurations (as illustrated in FIG. 11, for example) a combination of sampling module 1184 and the change detection module 1192 may be used. For instance, the change detection module 1192 may be used when operating according to the CARC state 1101 and the sampling module 1184 may be used when operating according to the MARC state 1105. The difference detection module 1104 may additionally include a frame SAD buffer 1198 for dynamically selecting threshold values based on historical SAD values.

The refresh module 1112 may be similar to the refresh module 112 discussed previously with respect to FIG. 1. The refresh module 1112 may include a CARC state 1101, a FULL state 1103, a MARC state 1105 and a SELF state 1116. The CARC state 1101 may be similar to one or more of the adaptive state 114 and the CARC state (e.g., CARC state 462) described above and with reference to FIG. 6. The FULL state 1103 may be similar to one or more of the FULL state (e.g., FULL state 434) described above and with reference to FIG. 9. The MARC state 1105 may be similar to one or more of the adaptive state 114 and the MARC state (e.g., MARC state 454) described above and with reference to FIG. 7. The SELF state 1116 may be similar to one or more of the SELF states (e.g., SELF state 116, 416) described above and with reference to FIG. 8.

The refresh module 1112 may additionally include a state determination module 1118. The state determination module 1118 may be similar to the state determination module 118 discussed previously with respect to FIG. 1. The state determination module 1118 may include a state update module 1107 for controlling (e.g., directing) transitions between states.

The state update module 1107 may control transitions between states based on various variables. In some configurations, the various variables may be stored in memory. Examples of variables include State 1111 (indicating the current operating state), FrameCount 1113 (indicating a number frame since a given start point), MaxStaleSkip 1115 (indicating a maximum frames that may be skipped so that a display may be refreshed before exceeding the maximum hold time of the display), MinChangedSkip 1117, nStaticToVideo 1119, StaleSkipCount 1121, ChangeDetected 1123, ChangedSkipCount 1125, nVideoToStatic 1127, etc. The state update module 1107 may obtain one or more difference indicators 1120 from the difference detection module 1104 and one or more indications 1122 (e.g., from an auxiliary link 1074, 1078). The state update module 1107 may control the operation of each state and the transitions between the states based on the indications and one or more variables. It is noted that the state update module 1107 may use the state 1111 to indicate the current operating state and determine subsequent operating states. An nStaticToVideo 1119 variable and an nVideoToStatic 1127 variable may be used for controlling the transitions between the video (MARC) state and the static (CARC) state. For example, when in the CARC state and the number of recent frames with change exceeds the nStaticToVideo variable, the state is changed to the MARC state. When in the MARC state and the number of consecutive frames with no change (e.g., static) exceeds the nVideoToStatic variable, the state is changed to the CARC state.

The refresh module 1112 may provide a refresh indicator 1124 to indicate a refresh to a refresh control 1176. In some configurations, the refresh indicator 1124 may include a RefreshFlag value (e.g., TRUE or FALSE) for indicating a refresh. The refresh control 1176 may include an output to a display interface 1129 that includes one or more frames (e.g., frame data 1151) and adapted refresh indications. The refresh control 1176 may be similar to the refresh control 1076 discussed previously with respect to FIG. 10.

Examples of how various state variables may be used for operation in each state are provided as follows. In some configurations, the Full Refresh (FULL) state 1103 may obtain incoming frames from a main link. In the FULL state 1103, the refresh indicator 124 (e.g., a refresh flag) may always indicate that a refresh should be made (for example, a refresh flag may always be set as 1 (e.g., high, TRUE, etc.)). In some configurations, the FrameCount 1113 (for counting frames, for example) may be incremented for each frame and may be used to determine when to exit this state.

In some configurations, the Self Refresh (SELF) state 1116 may obtain a frame from the frame memory 1194. Upon entry into the SELF state 1116, a frame from a main link may be stored in the frame memory 1194. In one configuration, the SELF state 1116 may include a variable that indicates the number of refresh cycles that are skipped (e.g., the StaleSkipCount 1121). If the StaleSkipCount 1121 is greater than or equal to a threshold (e.g., a MaxStateSkip 1115) then a refresh is indicated 124 (e.g., refresh flag=TRUE) and the StaleSkipCount 1121 is reset (e.g., StaleSkipCount=0). However, if the StaleSkipCount 1121 is less than a threshold (e.g., the MaxStateSkip 1115) then the StaleSkipCount 1121 is incremented (e.g., StaleSkipCount++) and a refresh is not indicated (e.g., refresh flag=False).

In some configurations, the Motion Adaptive (MARC) state 1105 may obtain incoming frames from a main link. At the beginning of each frame, a Frame SAD value may be set to zero. Each line of the frame data may be subsampled to a low resolution and a SAD calculation may be updated. At the end of each frame, the Frame SAD value may be written to a buffer (e.g., video motion buffer 1188). In the MARC state 1105, the ChangedSkipCount 1125 may indicate a number of frames to skip and the MinChangedSkip 1117 may indicate a skip threshold based on SAD history. At the beginning of each frame, the present value of the MinChangedSkip 1117 and the present value of the ChangedSkipCount 1125 are used to control the refresh indication 124 (e.g., refresh flag). If the ChangedSkipCount 1125 is greater than or equal to a threshold (e.g., MinChangedSkip 1117), then a refresh is indicated 124 (e.g., RefreshFlag=TRUE) and the ChangedSkipCount 1125 is reset (e.g., ChangedSkipCount=0.). However, if the ChangedSkipCount 1125 is less than a threshold (e.g., MinChangedSkip 1117), then the ChangedSkipCount 1125 is incremented (e.g., ChangedSkipCount++) and a refresh is not indicated (e.g., RefreshFlag=FALSE). It is noted that the value of MinChangedSkip 1117 may be based on recent SAD history.

In one configuration, the change adaptive (CARC) state 1101 may obtain incoming frames from a main link. At the beginning of each frame, the present value of ChangeDetected 1123 as well as StaleSkipCount 1121 and the MaxStateSkip 1115 may be used to control the refresh indication 124 (e.g., RefreshFlag variable). In the CARC state 1101, the ChangeDetected 1123 variable may indicate whether a change (between two frames, for example) has been detected. If a change has been detected (e.g., ChangeDetected=TRUE), then a refresh is indicated (e.g., RefreshFlag=TRUE) and the StaleSkipCount 1121 is reset (e.g., StaleSkipCount=0). However, if a change is not detected (e.g., ChangeDetected=FALSE) but the StaticSkipCount 1121 is greater than or equal to a threshold (e.g., MaxStateSkip 1115) then a refresh is indicated 124 (e.g., RefreshFlag=TRUE) and the StaleSkipCount 1121 is reset (e.g., StaleSkipCount=0). However, if a change is not detected (e.g., ChangeDetected=FALSE) and the StaticSkipCount 1121 is less than a threshold (e.g., MaxStateSkip 1115), then a refresh is not indicated (e.g., RefreshFlag=FALSE) and the StaleSkipCount 1121 is incremented (e.g., StaleSkipCount++).

As described above, several state variables may be used to control the operations within each state. In some configurations, state variables may also be used to control the transitions between the individual states.

In some configurations, one or more of the electronic device 1102 and refresh control 1176 may be integrated into a single device, such as a display, monitor, television, touchscreen, etc. In other configurations, one or more of the electronic device 1102 and refresh control 1176 may be included within the host device 1170. In some cases, the source selector 1182 may be external to the electronic device 1102.

Figure 12:
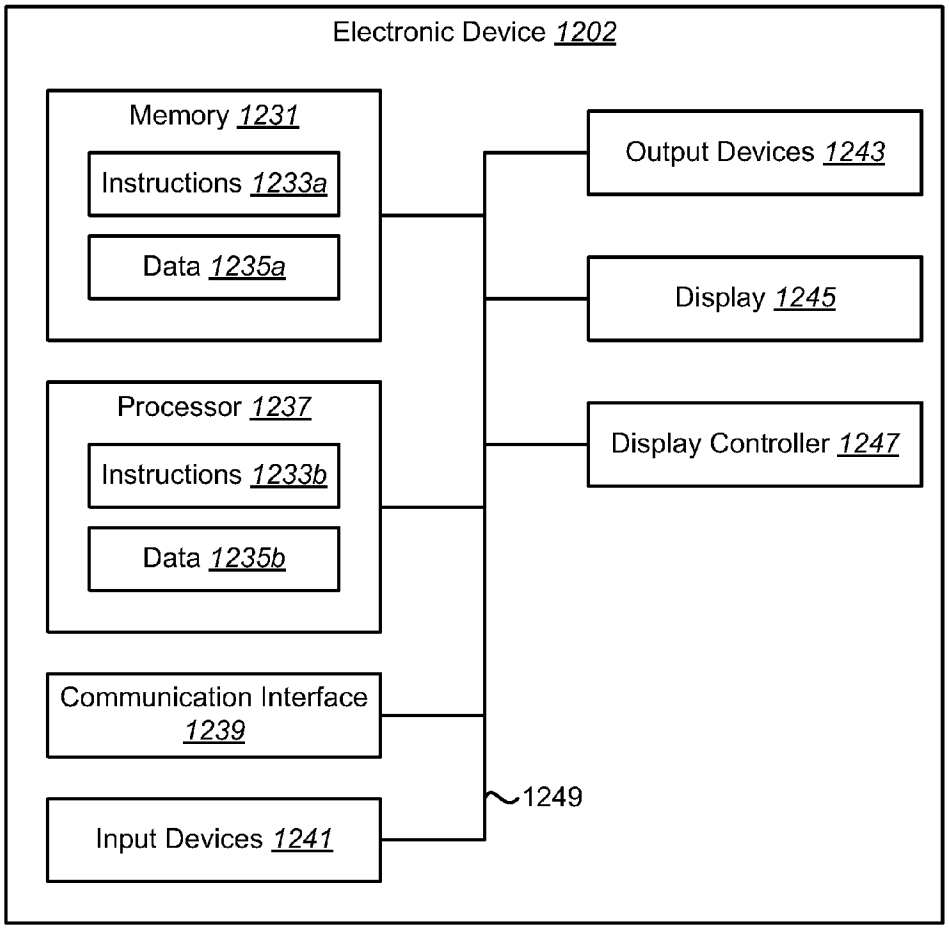
FIG. 12 illustrates various components that may be utilized in an electronic device.

FIG. 12 illustrates various components that may be utilized in an electronic device 1202. The electronic device 1202 may be implemented as one or more of the electronic devices (e.g., electronic devices 102, 1002, 1102) described previously.

The electronic device 1202 includes a processor 1237 that controls operation of the electronic device 1202. The processor 1237 may also be referred to as a CPU. Memory 1231, which may include both read-only memory (ROM), random access memory (RAM) or any type of device that may store information, provides instructions 1233*a* (e.g., executable instructions) and data 1235*a* to the processor 1237. A portion of the memory 1231 may also include non-volatile random access memory (NVRAM). The memory 1231 may be in electronic communication with the processor 1237.

Instructions 1233*b* and data 1235*b* may also reside in the processor 1237. Instructions 1233*b* and/or data 1235*b* loaded into the processor 1237 may also include instructions 1233*a* and/or data 1235*a* from memory 1231 that were loaded for execution or processing by the processor 1237. The instructions 1233*b* may be executed by the processor 1237 to implement the systems and methods disclosed herein.

The electronic device 1202 may include one or more communication interfaces 1239 for communicating with other electronic devices. The communication interfaces 1239 may be based on wired communication technology, wireless communication technology, or both. Examples of communication interfaces 1239 include a serial port, a parallel port, a Universal Serial Bus (USB), an Ethernet adapter, an IEEE 1394 bus interface, a small computer system interface (SCSI) bus interface, an infrared (IR) communication port, a Bluetooth wireless communication adapter, a wireless transceiver in accordance with 3rd Generation Partnership Project (3GPP) specifications and so forth.

The electronic device 1202 may include one or more output devices 1243 and one or more input devices 1241. Examples of output devices 1243 include a speaker, printer, etc. One type of output device that may be included in an electronic device 1202 is a display device 1245. Display devices 1245 used with configurations disclosed herein may utilize any suitable image projection technology, such as a cathode ray tube (CRT), liquid crystal display (LCD), light-emitting diode (LED), gas plasma, electroluminescence or the like. A display controller 1247 may be provided for converting data stored in the memory 1231 into text, graphics, and/or moving images (as appropriate) shown on the display 1245. Examples of input devices 1241 include a keyboard, mouse, microphone, remote control device, button, joystick, trackball, touchpad, touchscreen, lightpen, etc.

The various components of the electronic device 1202 are coupled together by a bus system 1249, which may include a power bus, a control signal bus and a status signal bus, in addition to a data bus. However, for the sake of clarity, the various buses are illustrated in FIG. 12 as the bus system 1249. The electronic device 1202 illustrated in FIG. 12 is a functional block diagram rather than a listing of specific components.

The term "computer-readable medium" refers to any available medium that can be accessed by a computer or a processor. The term "computer-readable medium," as used herein, may denote a computer- and/or processor-readable medium that is non-transitory and tangible. By way of example, and not limitation, a computer-readable or processor-readable medium may comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer or processor. Disk and disc, as used herein, includes compact disc (CD), laser disc, optical disc, digital versatile disc (DVD), floppy disk and Blu-ray® disc where disks usually reproduce data magnetically, while discs reproduce data optically with lasers.

It should be noted that one or more of the methods described herein may be implemented in and/or performed using hardware. For example, one or more of the methods or approaches described herein may be implemented in and/or realized using a chipset, an application-specific integrated circuit (ASIC), a large-scale integrated circuit (LSI) or integrated circuit, etc.

Each of the methods disclosed herein comprises one or more steps or actions for achieving the described method. The method steps and/or actions may be interchanged with one another and/or combined into a single step without departing from the scope of the claims. In other words, unless a specific order of steps or actions is required for proper operation of the method that is being described, the order and/or use of specific steps and/or actions may be modified without departing from the scope of the claims.

It is to be understood that the claims are not limited to the precise configuration and components illustrated above. Various modifications, changes and variations may be made in the arrangement, operation and details of the systems, methods, and apparatus described herein without departing from the scope of the claims.

What is claimed is:

1. A method for adapting refresh behavior on an electronic device, comprising:

operating according to an adaptive state that adapts a refresh rate for a display based on at least one frame;

transitioning from the adaptive state to a self refresh state based on a first self refresh state indication;

transitioning from the self refresh state to the adaptive state based on a second self refresh state indication, wherein the adaptive state is a change adaptive state that indicates a refresh when a change is detected; and transitioning from the change adaptive state to a motion adaptive state when a number of frames exceeds a first threshold, wherein the motion adaptive state indicates a refresh for a fraction of the one or more frames.

2. The method of claim 1, wherein the self refresh state indicates a refresh based on a static frame in memory, and wherein the refresh is at a reduced refresh rate sufficient to maintain a static image on the display.

3. The method of claim 1, further comprising detecting a difference between at least two frames.

4. The method of claim 3, wherein the at least two frames are compressed frames.

5. The method of claim 3, wherein detecting a difference between the at least two frames is based on a Sum of Absolute Difference (SAD) between the at least two frames.

6. The method of claim 5, wherein the at least two frames are compressed frames.

7. The method of claim 1, wherein the adaptive state is a motion adaptive state that indicates a refresh for a fraction of the at least one frame.

8. The method of claim 1 wherein the number of frames comprises a number of frames with detected differences between two frames, and wherein the method further comprises:

transitioning from one of the self refresh state, change adaptive state and motion adaptive state to a full refresh state when a full refresh state indication is obtained, wherein the full refresh state indicates a refresh for each of the one or more frames;

transitioning from the full refresh state to the change adaptive state when a number of small SAD frames exceeds a second threshold;

transitioning from the motion adaptive state to the self refresh state when the first self refresh state indication is obtained;

transitioning from the motion adaptive state to the change adaptive state when a measure of activity of frames exceeds a third threshold; and transitioning from the self refresh state to the full refresh state when the full refresh indication is obtained.

9. The method of claim 8, wherein the full refresh indication is based on touch information.

10. The method of claim 1, further comprising determining whether a state transition will occur following each frame.

11. The method of claim 1, wherein the electronic device resides in a host device.

12. The method of claim 1, wherein the electronic device resides in a display device.

13. The method of claim 12, wherein the electronic device is part of a Timing Controller (TCON) module.

14. An electronic device configured for adapting refresh behavior, comprising:

a processor;

memory in electronic communication with the processor;

instructions stored in the memory, the instructions being executable to:

operate according to an adaptive state that adapts a refresh rate for a display based on at least one frame;

transition from the adaptive state to a self refresh state based on a first self refresh state indication;

transition from the self refresh state to the adaptive state based on a second self refresh state indication, wherein the adaptive state is a change adaptive state that indicates a refresh when a change is detected; and transition from the change adaptive state to a motion adaptive state when a number of frames exceeds a first threshold, wherein the motion adaptive state indicates a refresh for a fraction of the one or more frames.

15. The electronic device of claim 14, wherein the self refresh state indicates a refresh based on a static frame in memory, and wherein the refresh is at a reduced refresh rate sufficient to maintain a static image on the display.

16. The electronic device of claim 14, wherein the instructions are further executable to detect a difference between at least two frames.

17. The electronic device of claim 16, wherein the at least two frames are compressed frames.

18. The electronic device of claim 16, wherein detecting a difference between the at least two frames is based on a Sum of Absolute Difference (SAD) between the at least two frames.

19. The electronic device of claim 18, wherein the at least two frames are compressed frames.

20. The electronic device of claim 14, wherein the adaptive state is a motion adaptive state that indicates a refresh for a fraction of the at least one frame.

21. The electronic device of claim 14 wherein the number of frames comprises a number of frames with detected differences between two frames, and wherein the instructions are further executable to:

transition from one of the self refresh state, change adaptive state and motion adaptive state to a full refresh state when a full refresh state indication is obtained, wherein the full refresh state indicates a refresh for each of the one or more frames;

transition from the full refresh state to the change adaptive state when a number of small SAD frames exceeds a second threshold;

transition from the motion adaptive state to the self refresh state when the first self refresh state indication is obtained;

transition from the motion adaptive state to the change adaptive state when a measure of activity of frames exceeds a third threshold; and transition from the self refresh state to the full refresh state when the full refresh indication is obtained.

22. The electronic device of claim 21, wherein the full refresh indication is based on touch information.

23. The electronic device of claim 14, further comprising determining whether a state transition will occur following each frame.

24. The electronic device of claim 14, wherein the electronic device resides in a host device.

25. The electronic device of claim 14, wherein the electronic device resides in a display device.

26. The electronic device of claim 25, wherein the electronic device is part of a Timing Controller (TCON) module.

* * * * *